United States Patent [19]

Helwig et al.

[11] 3,967,984

[45] July 6, 1976

[54] METHOD FOR TREATING COATED FERROUS SUBSTRATES

[75] Inventors: Lawrence E. Helwig, Hampton Township, Allegheny County; Richard A. Neish, Snowden Township, Allegheny County, both of Pa.

[73] Assignee: United States Steel Corporation, Pittsburgh, Pa.

[22] Filed: Feb. 3, 1975

[21] Appl. No.: 546,657

[52] U.S. Cl. ..... 148/6.16; 148/6.2

[51] Int. Cl.[2] ..... C23F 7/26

[58] Field of Search ..... 148/6.2, 6.16

[56] References Cited

UNITED STATES PATENTS 2,507,956 5/1950 Bruno et al. ..... 148/6.2

2,798,829 7/1957 Newhard et al. ..... 148/6.2

OTHER PUBLICATIONS

De Long, Abstract of S.N. 725750, published 8–30–49.

*Primary Examiner*—Ralph S. Kendall

*Attorney, Agent, or Firm*—Arthur J. Greif

[57] ABSTRACT

An aqueous solution of 2.0 to 12.0 gm/l hexavalent chromium and 0.7 to 4.0 gm/l of sodium or ammonium bifluoride, adjusted to a pH of 2.7 to 5.5, is applied to coated (eg. Zn) ferrous substrates, metered to result in a final thickness of 0.8 to 2.0 mg of Cr per square foot of substrate surface, and thereafter dried to remove physically bound water.

9 Claims, No Drawings

METHOD FOR TREATING COATED FERROUS SUBSTRATES

This invention relates to chromate type conversion coatings and more particularly to methods and compositions for the passivation ferrous metal substrates coated with thin layers of Zn, Al or Pb base alloys.

Conversion coating compositions containing chromates as a principal constituent have long been employed for the passivation of coated ferrous metal surfaces such as galvanized steel, aluminum-coated steel and terne-coated steel. For example, with respect to galvanized steel such passivation treatments are employed to prevent the formation of a powdery film of zinc oxide known in the art as "white rust". Unprotected, galvanized steel is highly susceptible to the formation of this "white rust" when moisture is trapped between the sheets of a pack or between the laps of a coil. At the exposed regions (i.e. the edges) of the stacked sheets or coils, the film of water will have a considerable amount of oxygen dissolved therein, whereas the water film in the less exposed areas will be relatively oxygen free. As a result thereof, the areas with water films of higher oxygen contents will be at a higher potential and thereby more noble. Thus, a galvanic cell is established which results in the formation of "white rust". It is often the case, that such "white rust" is readily noticeable even during the short period of time required for shipment of the finished product to the customer.

A number of compositions containing fluosilicates, fluorides, borates, phosphates, etc., as addition agents to the chromates, have been employed with varying degrees of effectiveness. However, it has generally been the case that the most effective compositions result in an undesirable discoloration of the galvanized surface. Another undesirable feature of such effective coating compositions, is the requirement for continual, close control of both the concentration of the treating solution and the ratio of the constituents; otherwise the degree of protection obtained is seriously diminished.

It is therefore an object of this invention to provide a composition for effectively passivating galvanized, aluminum-coated and terne-coated ferrous metal substrates.

It is a further object of this invention to provide a passivation method and composition which does not discolor the metal surface.

It is yet another object of this invention to provide a passivation method and composition which may practically and effectively be employed, while avoiding the need for continual, close control of the solution concentration.

These and other objects and advantages of this invention will become more apparent from the following description when taken in conjunction with the appended claims.

The composition of this invention is an aqueous solution containing: (a) 2.0 to 12.0 gms/liter of hexavalent chromium; wherein it is preferred that a major portion of the $Cr^{+6}$ be supplied by either $Na_2Cr_2O_7$ or $K_2Cr_2O_7$ or mixtures of the two and (b) 0.7 to 4.0 gm/l of an alkali metal or ammonium bifluoride. The solution is adjusted to a pH range of 2.7 to 5.5, preferably 3.5 to 4.7. Higher pH's result in a coating with poorer corrosion protection, while lower pH's result in (i) a stained and/or yellowish colored coating and (ii) too fast a reaction between the solution and the metal surface.

With respect to (i), the color can be removed by subsequent bleaching in alkaline solutions, but this additional step increases cost and reduces the protection afforded by the film. With respect to (ii), fast reaction times are not practical for commercial lines operating at typical speeds of 150 to 500 ft./min. This is because in commercial practice it is generally necessary to vary line speed due to changes in strip width and gage; the amount Zn to be applied; as well as to actually stop the line, eg. due to need for welding of two coils. Thus, when the line is stopped or operated at a comparatively slow line speed, a too fast reaction would produce undesirable coloration. On the other hand, slow reaction times are particularly desirable in commercial practice, since little or no reaction will occur during the period when the metal substrate in the treatment bath. Thus, utilizing the instant invention, no discoloration occurred even for line stops lasting about 5 minutes. Additionally, as a result of such slower reaction times, no difficulty is encountered in maintaining a chemical balance (concentration and ratio of constituents) of the bath.

It is desirable that the acid employed for pH adjustment provide no extraneous cations, and preferably no extraneous anions, as well. Therefore, the use of chromic acid for pH adjustment is particularly preferred, since it merely acts as a source of hexavalent chromium. No other addition agents or activators need be added, and it is preferable that one well known activator, i.e., phosphates, not be added as a purposeful addition. It has been found that phosphates actually produced an inferior product, either as a result of poorer corrosion protection or because of discoloration of the surface. Equally important, it was found that $PO_4$ in solution often reacted with the plastic lined rolls, (eg. guide rolls, drive rolls, wringer rolls) normally employed in applying conversion coatings; causing the coated strip to adhere to the rolls with the result that the coating was often torn from the strip. It is therefore essential that the $PO_4$ content should not exceed 0.5 gms/liter, and desirably be less than 0.1 gms/liter.

The passivation process may therefore be conducted as follows. The aqueous coating solution (preferably containing 12 to 22 gms/l dichromate) is applied to a cleaned metal surface by any of the methods well known to the art such as; immersion, spraying, roller coating or flow coating. While the temperature of the solution may vary between wide limits, a temperature range of 45° – 95°C has been found more practical; with temperatures between 70° and 90°C being most preferable both in providing superior corrosion protection and being suitable for the subsequent drying. The time of contact is not critical, and good results have been achieved with immersion times as short as one-fourth of a second. Although longer contact times (eg. up to 10 minutes) provide no additional advantages, they may of course be employed. No rinsing is employed. The film, when initially applied, is very water soluble. Since reaction between the film and the metal surface is initially minimal; if a rinse were to be employed it would remove the bulk of the film, and the sheet would not be resistant to humid-storage staining. As the film ages it becomes more insoluble, and more protective. Thus, after about a day the film is about 50% insoluble, and after two days it reaches an equilibrium condition of about 80% insolubility. Optimum stain resistance is achieved at this stage, when the film is mostly insoluble, but nevertheless has some soluble chromium to aid in the repair of film discontinuities caused by abrasion, overheating, etc. The omission of a water rinse after the passivation treatment is additionally advantageous, in that it obviates the need for an extra step of repurification of rinse water. Subsequent to application of the solution, the film adhering to the metal surface is then metered, eg. by being passed through wringer rolls, so as to provide a final coating containing from 0.8 to 2.0 mg of Cr per square foot of substrate surface. Thinner coatings tend to give inferior corrosion protection, while heavier coatings result in staining and discoloration. The amount of chromium remaining on the strip will generally be controlled by the concentration of the treating solution and by the severity of the metering operation (eg., the smoothness of the wringer rolls and the pressure exerted thereby). The metered coating is then dried (for example, by the application of hot air, desirably at a temperature of 50° to 120°C) to remove substantially all of the physically bound water. The thus treated strip is then passed through the remaining portions of the line, as required.

We claim:

1. In the method for the treatment of ferrous metal substrates coated with thin layers of Zn base alloys the improvement which comprises, applying to said coated substrate a solution consisting essentially of, (a) 2.0 to 12.0 gms/l of hexavalent chromium, (b) 0.7 to 4.0 gms/l of a bifluoride selected from the group consisting of $NaHF_2$, $NH_4HF_2$ and mixtures thereof, and (c) less than 0.5 gms/l of phosphate, said solution adjusted to a pH within the range 2.7 to 5.5, metering the amount of solution remaining on the surface of said substrate to provide a final coating thickness of 0.8 to 2.0 mg. of Cr per square foot of substrate surface and thereafter;

drying the thus coated substrate to remove substantially all of the physically bound water in said film.

2. The method of claim 1, in which said pH is 3.5 to 4.7, and said phosphate is less than 0.1 gms/l.

3. The method of claim 2, in which a major portion of said hexavalent chromium is supplied by a dichromate selected from the group consisting of $Na_2Cr_2O_7$, $K_2Cr_2O_7$ or mixtures thereof.

4. The method of claim 3 in which said dichromate concentration is 12–22 gms/l.

5. In the method for the treatment of ferrous metal substrates coated with thin layers of a metal selected from a group consisting of Zn, Al and Pb base alloys;

the improvement which comprises, applying to said coated substrate a solution consisting essentially of, (a) 2.0 to 12.0 gms/l of hexavalent chromium, and (b) 0.7 to 4.0 gms/l of a bifluoride selected from the group of $NaHF_2$, $NH_4HF_2$ and mixtures thereof, (c) less than 0.5 gms/l of phosphate, said solution adjusted to a pH within the range 2.7 to 5.5;

metering the amount of solution remaining on the surface of said substrate to provide a final coating thickness of 0.8 to 2.0 mg. of Cr per square foot of substrate surface and thereafter;

drying the thus coated substrate to remove substantially all of the physically bound water in said film.

6. The method of claim 5, wherein the pH of said solution is within the range 3.5 to 4.7 and said phosphate is less than 0.1 g/l.

7. The method of claim 6, wherein a major portion of said hexavalent chromium is supplied by a dichromate selected from the group consisting of $Na_2Cr_2O_7$, $K_2Cr_2O_7$ or mixtures thereof.

8. The method of claim 7, wherein said application is accomplished by passing the substrate through said solution maintained at a temperature of 45° to 95°C, for an immersion time in excess of 0.25 seconds.

9. The method of claim 8, wherein said immersion time is not greater than about 5 minutes, and said drying is accomplished by the blowing of hot air at a temperature of 50° to 120°C.

* * * * *